US007600829B2

(12) United States Patent
Oh et al.

(10) Patent No.: US 7,600,829 B2
(45) **Date of Patent: *Oct. 13, 2009**

(54) REFRIGERATOR HAVING BASKET LIFT APPARATUS

(75) Inventors: Seung-Hwan Oh, Gyeonggi-Do (KR); Kyung-Han Jeong, Seoul (KR); Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 492 days.

This patent is subject to a terminal disclaimer.

(21) Appl. No.: 11/024,475

(22) Filed: Dec. 30, 2004

(65) Prior Publication Data

US 2006/0042301 A1 Mar. 2, 2006

(30) Foreign Application Priority Data

Aug. 26, 2004 (KR) ..... 10-2004-0067606

(51) Int. Cl.
*A47B 96/04* (2006.01)
*A47B 95/02* (2006.01)

(52) U.S. Cl. ..... 312/404; 312/402; 312/319.5

(58) Field of Classification Search ..... 312/404.401, 312/400, 402, 330.1, 319.1–319.9, 304, 306, 312/307, 21–30, 223.2, 234.44; 108/144.11, 108/145–148; 62/407; 188/171, 161, 163, 188/322.5; 192/143, 144; 310/77, 93, 94; 74/49, 50, 55, 53, 411.5, 89.17, 422
See application file for complete search history.

(56) References Cited

U.S. PATENT DOCUMENTS 2,497,734 A * 2/1950 Kuklich ..... 312/312
2,509,806 A * 5/1950 Byars ..... 312/241
2,861,857 A * 11/1958 Lee et al. ..... 312/312
3,246,939 A 4/1966 Petkwitz et al.
4,527,675 A * 7/1985 Omata et al. ..... 188/290
4,568,132 A * 2/1986 Watt ..... 312/312
4,574,423 A * 3/1986 Ito et al. ..... 16/85
4,790,611 A * 12/1988 Craner ..... 312/306
5,090,521 A * 2/1992 Miura ..... 188/82.1
5,211,267 A * 5/1993 Clark ..... 188/276
5,429,043 A * 7/1995 Becker ..... 99/448
5,460,252 A * 10/1995 Kosugi et al. ..... 188/291
5,586,816 A 12/1996 Geiss, II et al.
6,119,838 A * 9/2000 Igari et al. ..... 192/45.1
6,302,252 B1 * 10/2001 Iga ..... 192/45.1
6,729,448 B2 * 5/2004 Takahashi ..... 188/294

(Continued)

FOREIGN PATENT DOCUMENTS

DE 297 01 227 U1 6/1997

(Continued)

OTHER PUBLICATIONS

Translation of JP 05-296647, Schreiber Translation, Inc., Nov. 2006.*

*Primary Examiner*—Lanna Mai
*Assistant Examiner*—Timothy M Ayres
(74) *Attorney, Agent, or Firm*—Birch, Stewart, Kolasch & Birch, LLP

(57) ABSTRACT

A refrigerator having a basket lift apparatus comprises: a body having cooling chambers for storing food; a basket accommodated in the cooling chamber arranged at a lower portion of the body in a slidable manner; a lifting unit for lifting the basket when the basket is drawn out of the cooling chamber; and a damping unit installed at the lifting unit, for absorbing an impact generated when the basket lifted by the lifting unit is descended. When the basket is descended, a damping force is generated thereby to absorb an impact due to a drastic descent of the basket.

10 Claims, 10 Drawing Sheets

U.S. PATENT DOCUMENTS

| | | | | |
|---|---|---|---|---|
| 6,866,588 | B2 * | 3/2005 | Doornbos | 464/40 |
| 7,093,703 | B2 * | 8/2006 | Ikeda et al. | 192/41 A |
| 2004/0100168 | A1 | 5/2004 | Choi | |
| 2005/0073225 | A1 | 4/2005 | Kwon et al. | |

FOREIGN PATENT DOCUMENTS

| | | | |
|---|---|---|---|
| GB | 2 406 633 | A | 4/2005 |
| JP | 63-43094 | U | 3/1988 |
| JP | 05-296647 | A | 11/1993 |
| KR | 100159711 | B1 | 8/1998 |
| WO | WO-01/71263 | A | 9/2001 |

* cited by examiner

REFRIGERATOR HAVING BASKET LIFT APPARATUS

BACKGROUND OF THE INVENTION

1. Field of the Invention

The present invention relates to a refrigerator having a basket lift apparatus, and more particularly, to a refrigerator having a basket lift apparatus capable of enhancing a user's convenience by lifting a basket installed at a lower portion of a body when the basket is drawn out of a lower cooling chamber.

2. Description of the Conventional Art

FIG. 1 is a perspective view showing a refrigerator in accordance with the conventional art, and FIG. 2 is a sectional view of a refrigerator showing a state that a basket is accommodated in a body.

The conventional refrigerator comprises: a body 102 having an opened front side and an accommodation space; an upper cooling chamber 106 arranged at an upper side of the body 102 and having a pair of upper doors 104 opened to 20 both sides, for storing food; and a lower cooling chamber 112 arranged at a lower side of the body 102, separated from the upper cooling chamber 106 by a partition wall 108, and having a lower door 110 opened in a slidable manner.

A mechanical chamber 116 having a compressor 114 for generating cold air to be supplied to the upper cooling chamber 106 and the lower cooling 25 chamber 112, etc. is installed at a rear side of the body 102.

A basket 120 for accommodating food is arranged at the lower cooling chamber 112 to be slidable back and forth, and the lower door 110 is fixed at a front side of the basket 120. According to this, when the lower door 110 is pulled, the basket 120 is opened, and when the lower door 110 is pushed, the basket 120 is closed. A guide rail 124 is installed between an inner side surface of the basket 120 and an inner side surface of the lower cooling chamber 112, thereby guiding the basket 120 to be slidable back and forth.

A plurality of drawers 126 for storing food are installed at an upper side of the basket 120 to be opened in a slidable manner.

In the conventional refrigerator, when a user forwardly pulls the lower door 110 in order to take out the food stored in the lower cooling chamber 112 or in order to accommodate food in the lower cooling chamber 112, the basket 120 is opened with a slide motion. Also, when the user backwardly pushes the lower door 110 after taking out the food stored in the basket 120 or accommodating food in the basket 120, the basket 120 is closed with a slide motion.

However, in the conventional refrigerator, since the basket is arranged at a lower portion of the refrigerator, the user has to bend his or her waist or has to crouch in order to take out the food stored in the basket or to accommodate food in the basket thereby to have inconvenience in using the basket.

SUMMARY OF THE INVENTION

Therefore, an object of the present invention is to provide a refrigerator having a basket lift apparatus capable of enhancing a user's convenience by lifting a basket installed at a lower portion of a body when the basket is drawn out of a lower cooling chamber.

Another object of the present invention is to provide a refrigerator having a basket lift apparatus capable of absorbing an impact generated when a basket is descended by installing a damping unit at the basket.

To achieve these and other advantages and in accordance with the purpose of the present invention, as embodied and broadly described herein, there is provided a refrigerator having a basket lift apparatus comprising: a body having cooling chambers for storing food; a basket accommodated in the cooling chamber arranged at a lower portion of the body in a slidable manner; a lifting unit for lifting the basket when the basket is drawn out of the cooling chamber; and a damping unit installed at the lifting unit, for absorbing an impact generated when the basket lifted by the lifting unit is descended.

The lifting unit includes: a lifting frame arranged at a rear surface of a door arranged at a front side of the cooling chamber to be movable up and down, and on which the basket is positioned; a driving arm roll-motioned at a lower surface of the lifting frame and rotatably supported at the door by a hinge shaft; and a driving unit connected to the hinge shaft and rotating the driving arm.

The damping unit includes: a housing fixed to the door and having a chamber in which viscosity fluid is contained therein; a rotation member rotatably arranged in the chamber of the housing and connected to the hinge shaft, for generating a damping force; an one-way bearing to which the hinge shaft is fixed and connected to the rotation member by a connection member, for generating a damping force only when the hinge shaft is rotated in a direction that the basket is descended.

The one-way bearing includes: an outer wheel rotatably arranged at a mounting groove formed at the housing; an inner wheel arranged at an inner circumferential surface of the outer wheel with a certain interval, and to the center thereof a hinge shaft is fixed; and a ball mounted between the outer wheel and the inner wheel with the same interval, roll-motioned when the hinge shaft is rotated in a direction that the basket is lifted, and locked between the outer wheel and the inner wheel when the hinge shaft is rotated in a direction that the basket is descended.

The connection member is composed of: a bearing connection portion mounted at an outer circumferential surface of the outer wheel and together rotated with the outer wheel; and a rotation shaft integrally connected to the bearing connection portion and fixed to the center of the rotation member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a basket lift apparatus will be explained in more detail with reference to the attached drawings.

Even if there may exist a plurality of preferred embodiments of the refrigerator having a basket lift apparatus according to the present invention, the most preferred embodiment will be explained hereinafter.

Figure 1:
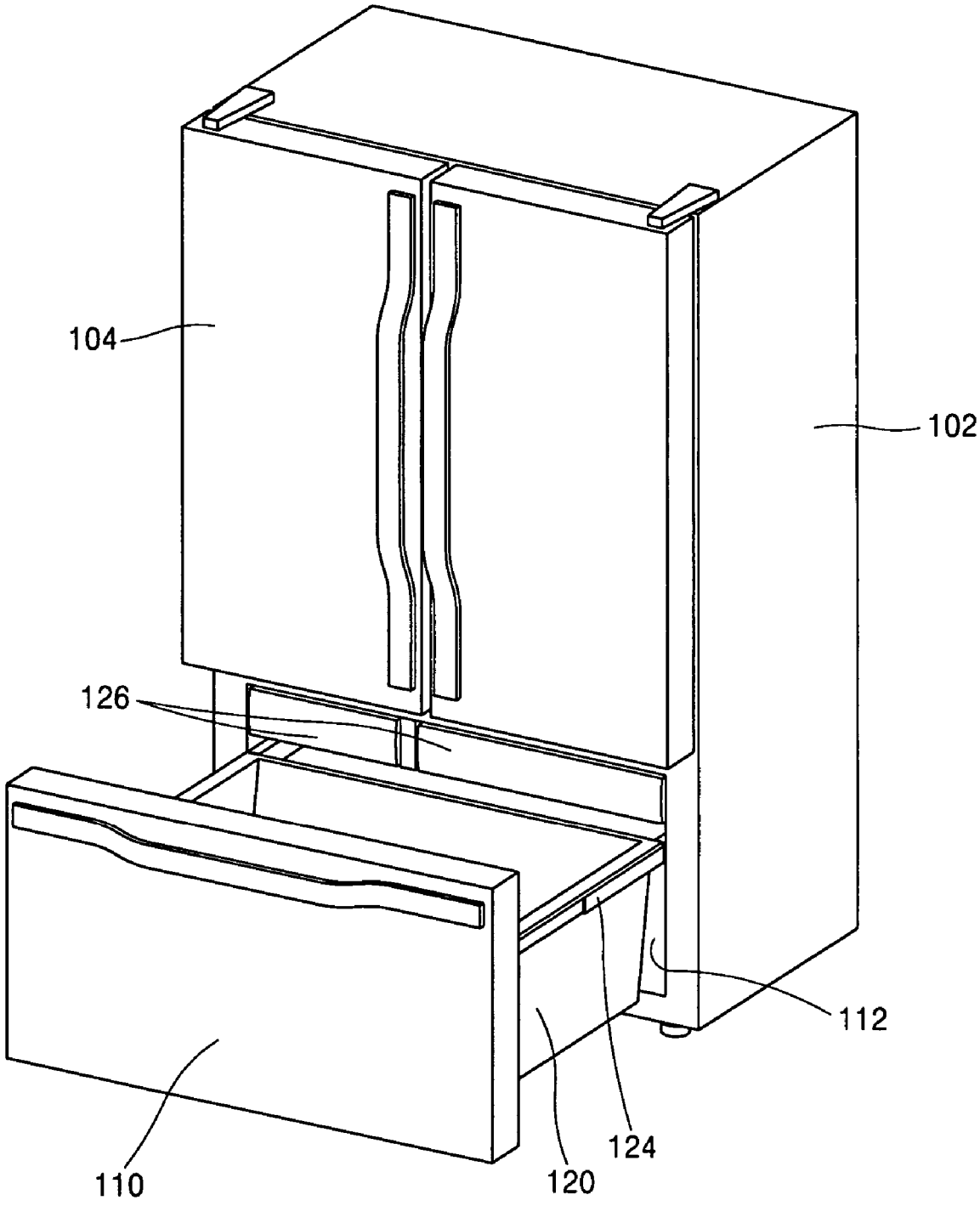
FIG. 1 CONVENTIONAL ART
FIG. 1 is a perspective view of a refrigerator in accordance with the conventional art.
Figure 2:
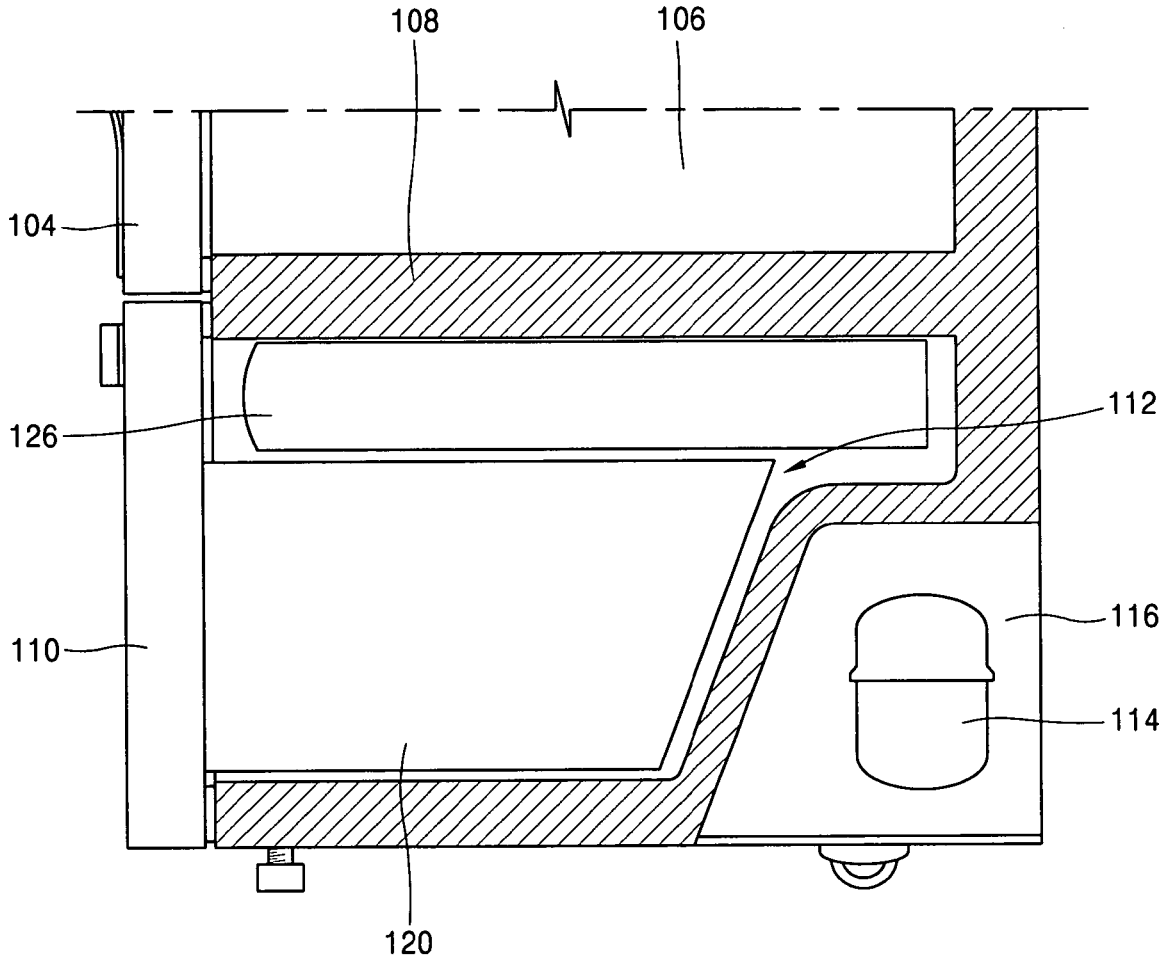
FIG. 2 CONVENTIONAL ART
FIG. 2 is a sectional view showing a lower portion of the refrigerator in accordance with the conventional art.
Figure 3:
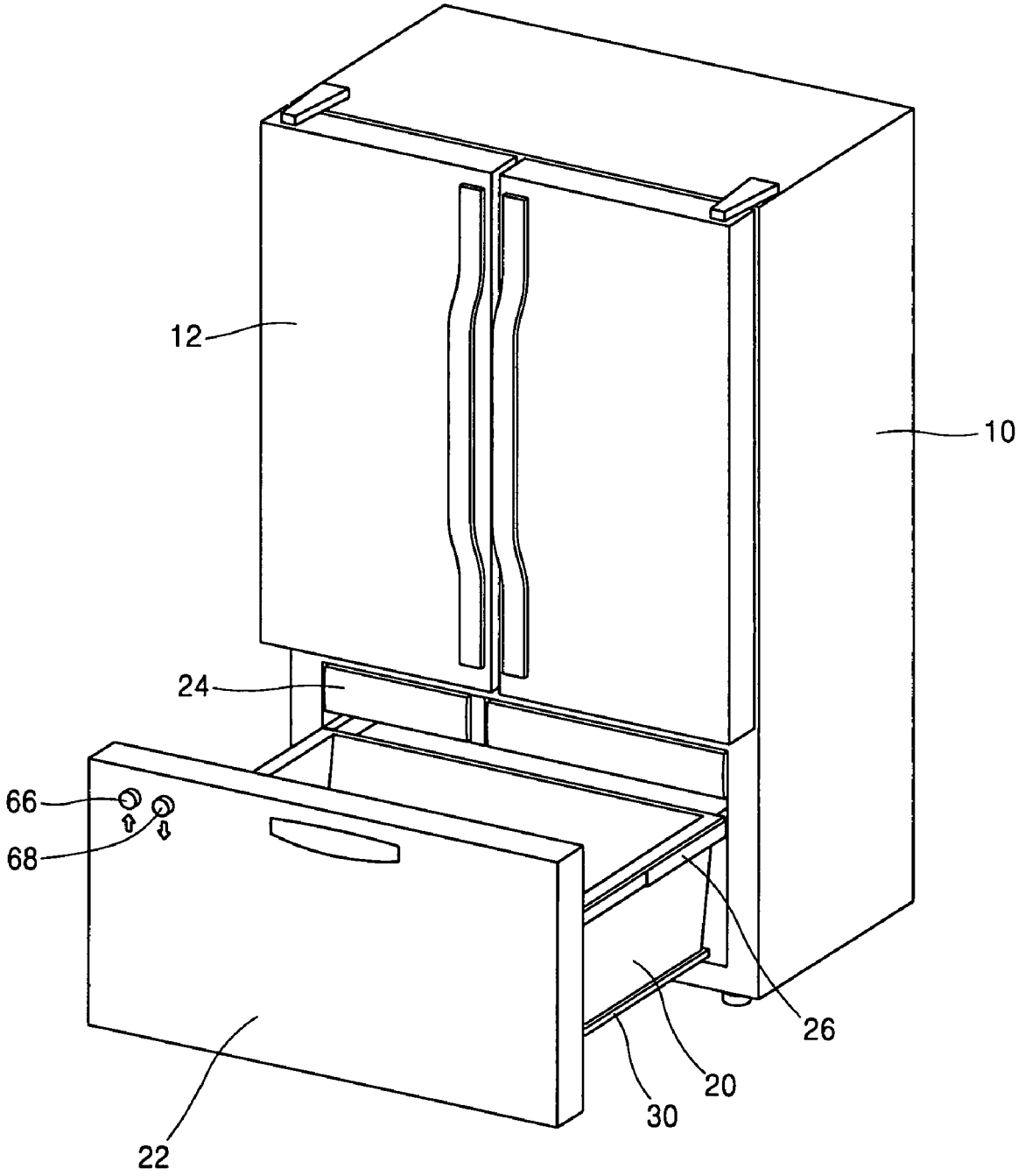
FIG. 3 is a perspective view of a refrigerator according to the present invention.
Figure 4:
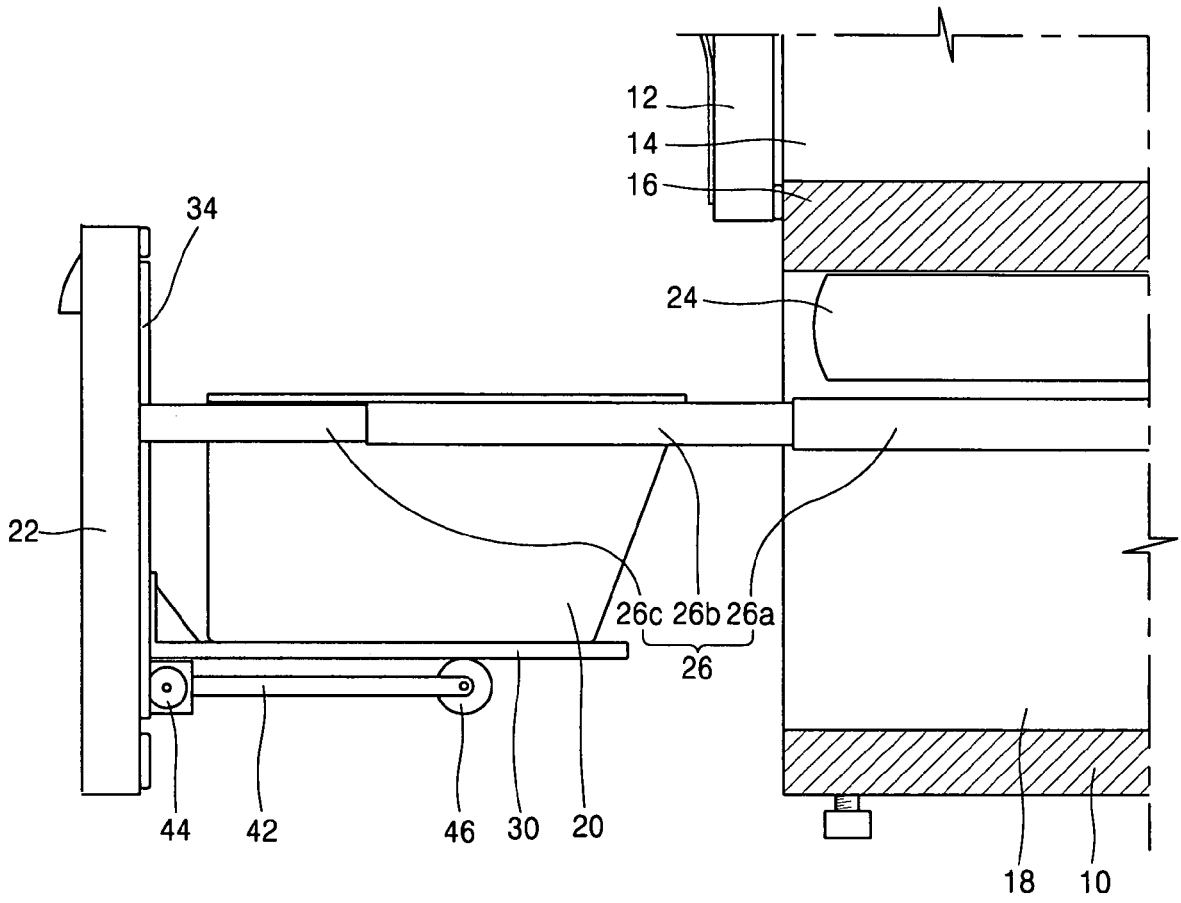
FIG. 4 is a sectional view showing a lower portion of the refrigerator in a refrigerator having a basket lift apparatus according to the present invention.

FIG. 3 is a perspective view of a refrigerator according to the present invention, and FIG. 4 is a sectional view showing a basket lift apparatus of the refrigerator according to the present invention.

The refrigerator according to the present invention comprises: a body 10 having an accommodation space; an upper cooling chamber 14 arranged at an upper side of the body 10 and having a pair of upper doors 12 opened to both sides; a lower cooling chamber 18 arranged at a lower side of the body 10 and separated from the upper cooling chamber 14 by a partition wall 16; a basket 20 arranged at the lower cooling chamber 18 to be slidable back and forth, for storing food; and a basket lift apparatus for lifting up the basket 20; and a damping unit 80 for absorbing an impact generated when the basket lifted by the basket lift apparatus is descended.

Preferably, the upper cooling chamber 14 is used as a cooling chamber for storing refrigerating food items, and the lower cooling chamber 18 is used as a freezing chamber for storing freezing food items.

A lower door 22 for pushing the basket 20 or drawing the basket 20 out of the lower cooling chamber 18 along back and forth directions of the body 10 is arranged at a front side of the lower cooling chamber 18. A plurality of drawers 24 drawn out along back and forth directions of the body 10 and for storing food are installed at an upper side of the lower cooling chamber 18.

A pair of guide rails 26 for guiding the lower door 22 to be slidable along back and forth directions of the body 10 is installed between both lateral surfaces of the lower cooling chamber 18 and a rear surface of the lower door 22.

The guide rail 26 is composed of: a fixed rail 26*a* fixed to both lateral surfaces of the lower cooling chamber 18; a middle rail 26*b* slidably connected to the fixed rail 26*a*; and a movable rail 26*c* slidably connected to the middle rail 26*b* and fixed to a rear surface off the lower door 22.

Figure 5:
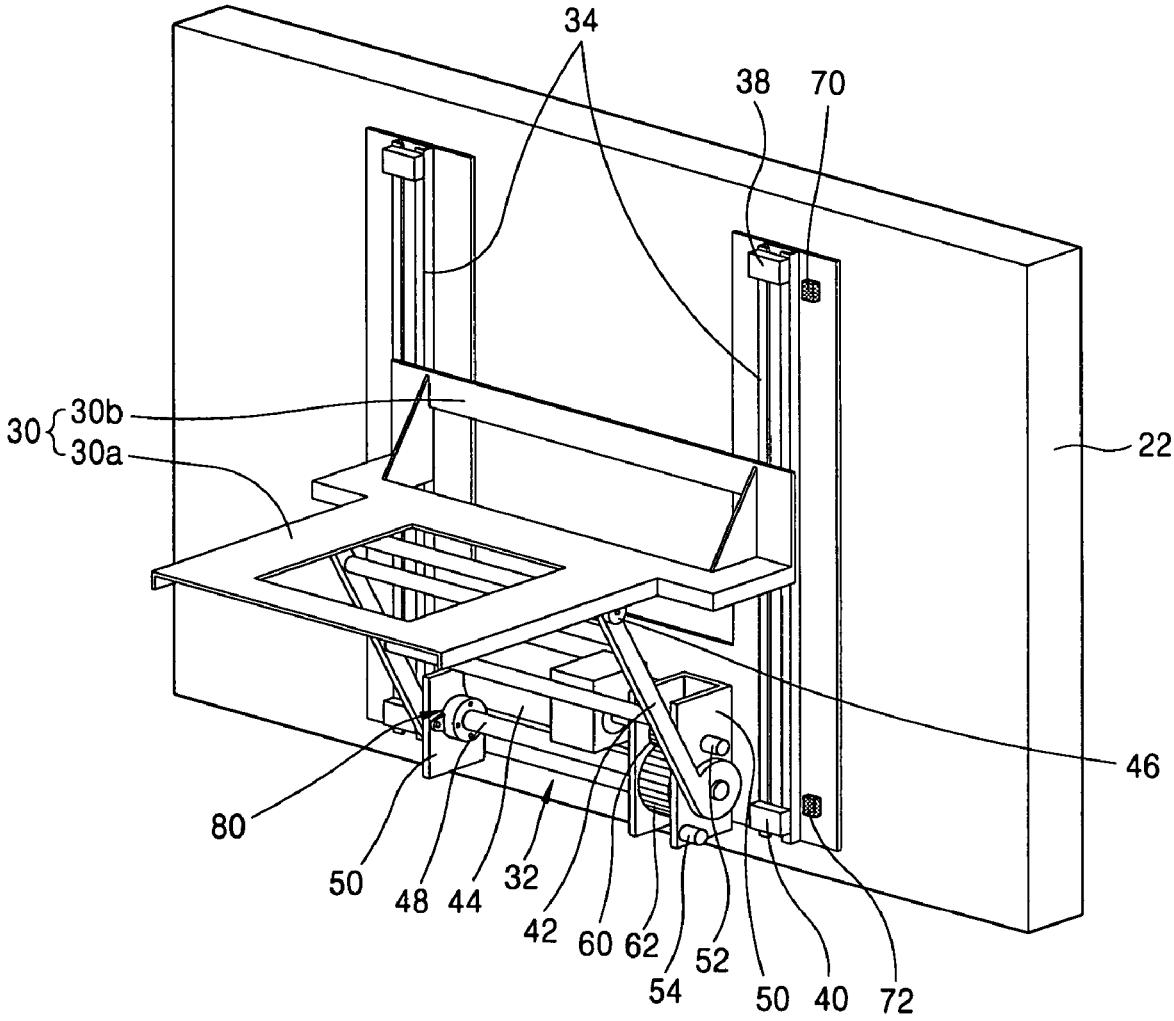
FIG. 5 is a perspective view of the basket lift apparatus of the refrigerator according to the present invention.
Figure 6:
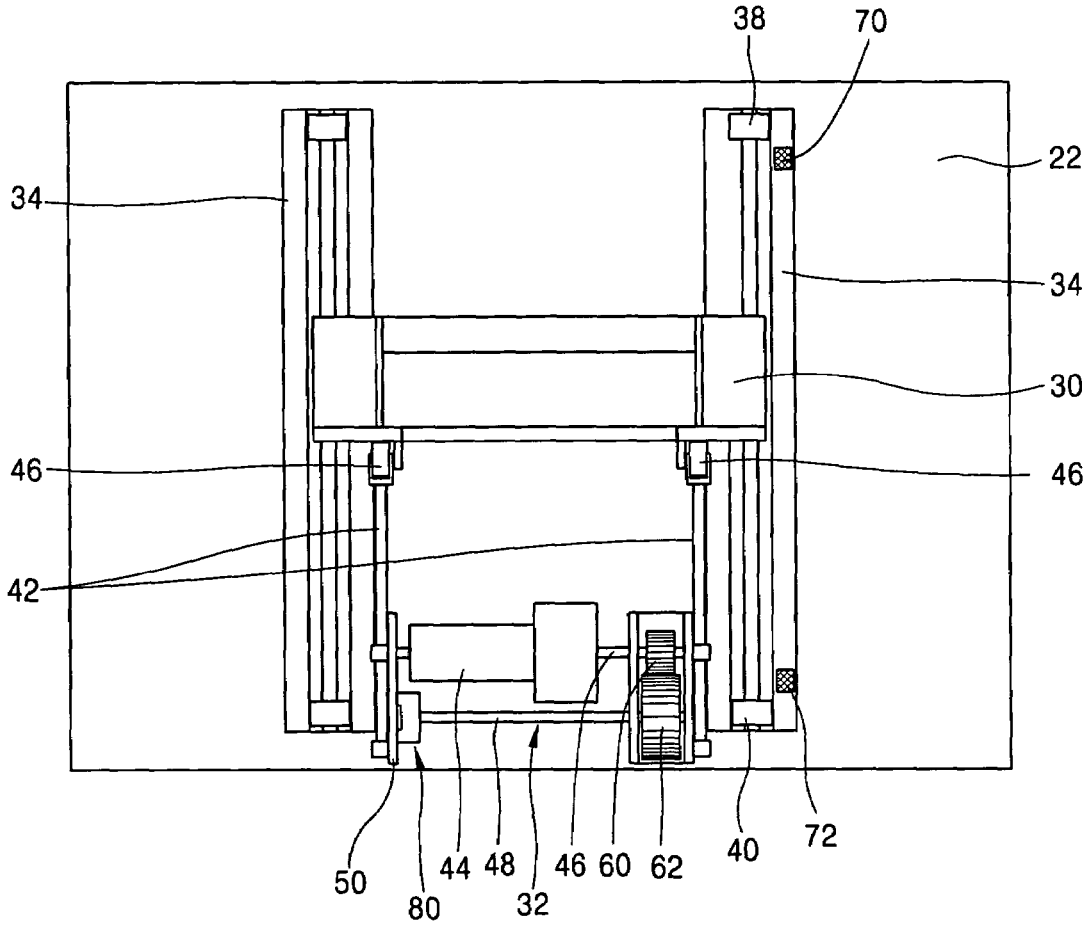
FIG. 6 is a frontal view of the basket lift apparatus of the refrigerator according to the present invention.

As shown in FIGS. 5 and 6, the basket lift apparatus includes: a lifting frame 30 arranged at a rear surface of the lower door 22 to be movable up and down, and on which the basket 20 is positioned; a driving unit 32 for moving the lifting frame 30 up and down; and a control unit for operating the driving unit 32 and thereby controlling the basket 20 to be movable up and down when the basket 20 is drawn out of the lower cooling chamber.

The lifting frame 30 is composed of: a mounting portion 30*a* formed as a flat plate type on which the basket 20 is positioned; and a lifting portion 30*b* curved at one side surface of the mounting portion 30*a* as a right angle thus to be arranged at a rear surface of the lower door 22 to be movable up and down.

A lifting rail 34 is installed at the rear surface of the lower door 22 thereby to support the lifting portion 30*b* of the lifting frame to be movable up and down.

An upper stopper 38 and a lower stopper 40 are respectively mounted at an upper end and a lower end of the lifting rail 34, thereby preventing the lifting frame 30 from being detached from the lower door 22.

The driving unit 32 is composed of: a driving arm 42 having one end roll-contacting a lower surface of the lifting frame 30 to be movable back and forth, and having another end rotatably mounted at the rear surface of the lower door 22; a driving motor 44 fixed to the rear surface of the lower door 22 and generating a driving force to rotate the driving arm 42; and a power transmitting unit for transmitting a driving force generated from the driving motor 44 to the driving arm 42.

A roller 47 roll-motioned at the lower surface of the lifting frame 30 is mounted at one end of the driving arm 42, and a hinge shaft 48 is mounted at another end of the driving arm 42. The hinge shaft 48 is rotatably supported at a supporting bracket 50 fixed to the rear surface of the lower door 22.

A first stopper 52 and a second stopper 54 for limiting a rotation range of the driving arm 42 are respectively formed at a lateral surface of the supporting bracket 50.

The power transmitting unit is composed of: a driving gear 60 fixed to the rotation shaft 46 of the driving motor 44 and arranged in the supporting bracket 50; and a driven gear 62 gear-engaged with the driving gear 60 and fixed to the hinge shaft 48.

The driving arm 42 is constructed as one pair respectively arranged at both sides of the lifting frame 30, and two driving arms 42 are connected to each other by the hinge shaft 48. As best seen in FIG. 6, a distance between the connections of the lifting frame 30 to the pair of lifting rails 34 measured in a lateral direction of the lower door 22 is greater than a distance between the pair of driving arms 42 measured in the lateral direction of the lower door 22.

When the driving motor 44 is driven, the driving gear 60 is rotated and thereby the driven gear 62 gear-engaged with the driving gear 60 is rotated. According to this, the hinge shaft 48 is rotated and thereby the driving arm 42 is rotated.

Figure 7:
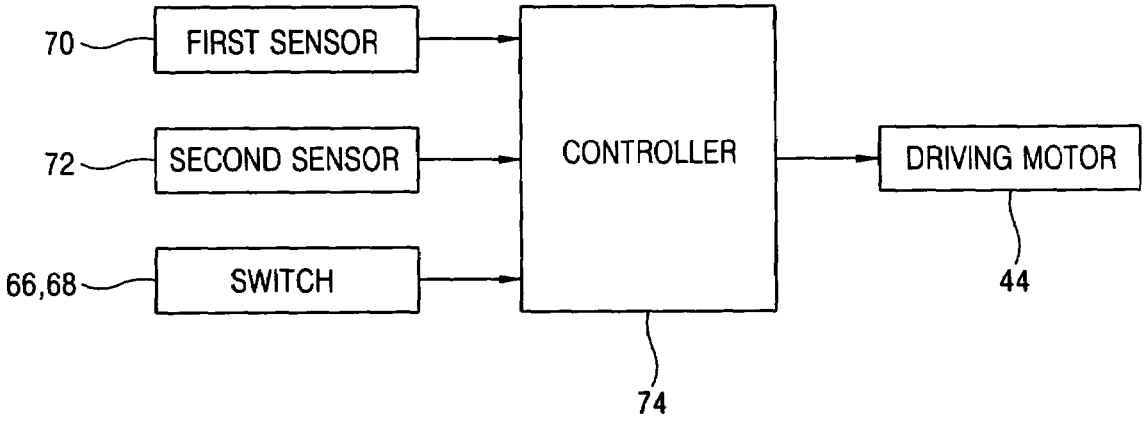
FIG. 7 is a block diagram showing a control unit of the basket lift apparatus of the refrigerator according to the present invention.

As shown in FIG. 7, the control unit for controlling a driving of the driving motor 44 by a user's adjustment is composed of: switches 66 and 68 adjusted by a user; a first sensor 70 mounted at an upper end of the lifting rail 34, for sensing a state that the lifting frame 30 is lifted to the maximum; a second sensor 72 mounted at a lower end of the lifting rail 34, for sensing a state that the lifting frame 30 is descended to the maximum; and a controller 74 for controlling an operation of the driving motor 44 according to a signal applied from the switches 66 and 68, the first sensor 70, and the second sensor 72.

The switches are composed of: a first switch 66 mounted at a front surface of the lower door 22 and adjusted by the user when the lifting frame 30 is to be lifted up; and a second switch 68 mounted at the front surface of the lower door 22 and adjusted by the user when the lifting frame 30 is to be descended.

Figure 8:
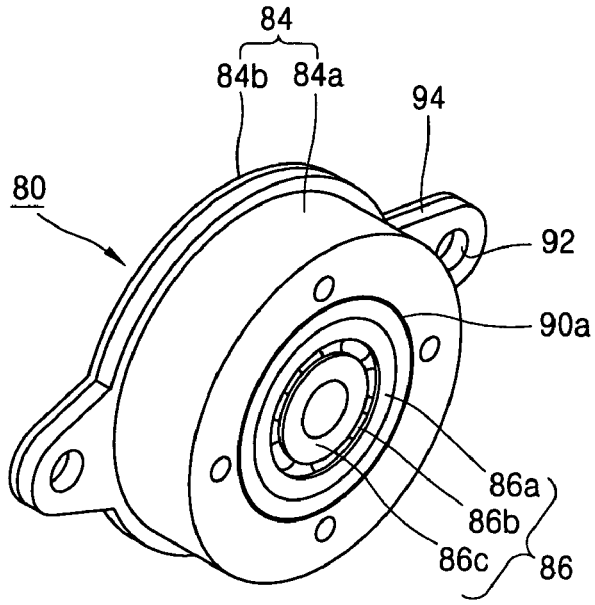
FIG. 8 is a perspective view of a damping unit of the refrigerator according to the present invention.
Figure 9:
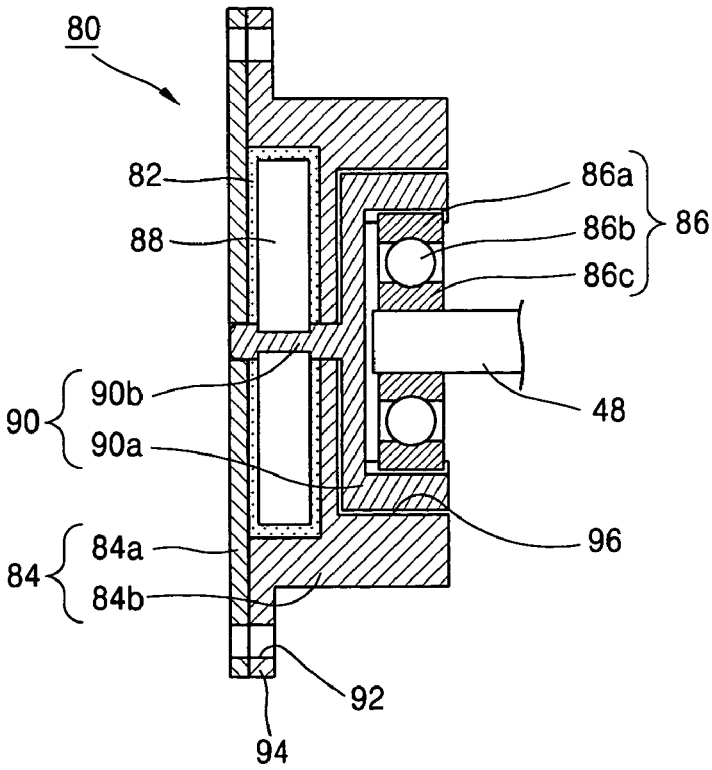
FIG. 9 is a sectional view of the damping unit of the refrigerator according to the present invention.

The damping unit is installed between the supporting bracket and the hinge shaft, and absorbs an impact generated when the basket is descended by generating a damping force only when the hinge shaft is rotated in a direction that the basket is descended As shown in FIGS. 8 and 9, the damping unit is composed of: a housing 84 fixed to the supporting bracket 50 and having a chamber 82 in which viscosity fluid is contained therein; an one-way bearing 86 arranged at one side of the housing 84 and to which the hinge shaft 48 is fixed; a rotation member 88 rotatably arranged in the chamber 82 of the housing 84 in which viscosity fluid is contained therein; and a connection member 90 for connecting the rotation member 88 and the one-way bearing 86.

The housing 84 is composed of a first member 84*a* and a second member 84*b* mounted with a hermetic space. The chamber 82 in which viscosity fluid is contained is formed between the first member 84*a* and the second member 84*b*. A coupling flange 94 having a bolt coupling hole 92 bolt-coupled to the supporting bracket 50 is formed at the edge of the chamber 82. A mounting groove 96 for rotatably mounting the one-way bearing 86 is formed at one side of the second member 84*b*.

The rotation member 88 is formed as a type having a plurality of blades or as a disc shape thus to generate a damping force with contacting the viscosity fluid contained in the chamber 82.

The one-way bearing 86 is composed of: an outer wheel 86*a* rotatably arranged at the mounting groove 96; an inner wheel 86*c* arranged at an inner circumferential surface of the outer wheel 86*a* with a certain interval, and to the center thereof the hinge shaft 48 is fixed; and a ball 86*b* mounted between the outer wheel 86*a* and the inner wheel 86*c* with the same interval and roll-motioned.

When the hinge shaft 48 is forwardly rotated, the ball 86*b* is roll-motioned not to transmit a rotation force of the inner wheel 86*c* to the outer wheel 86*a*. Also, when the hinge shaft 48 is backwardly rotated, the ball is locked between the inner wheel 86*c* and the outer wheel 86*a* and thereby the inner wheel 86*c* and the outer wheel 86*a* are integrally rotated together with the ball 86*b*.

The connection member 90 is composed of: a bearing connection portion 90*a* mounted at an outer circumferential surface of the outer wheel 86*a* of the one-way bearing 86 and together rotated with the outer wheel 86*a*; and a rotation shaft 90*b* extended from one side of the bearing connection portion 90*a* thus to be mounted at the center of the rotation member 88.

An operation of the basket lift apparatus according to the present invention will be explained as follows.

Figure 10:
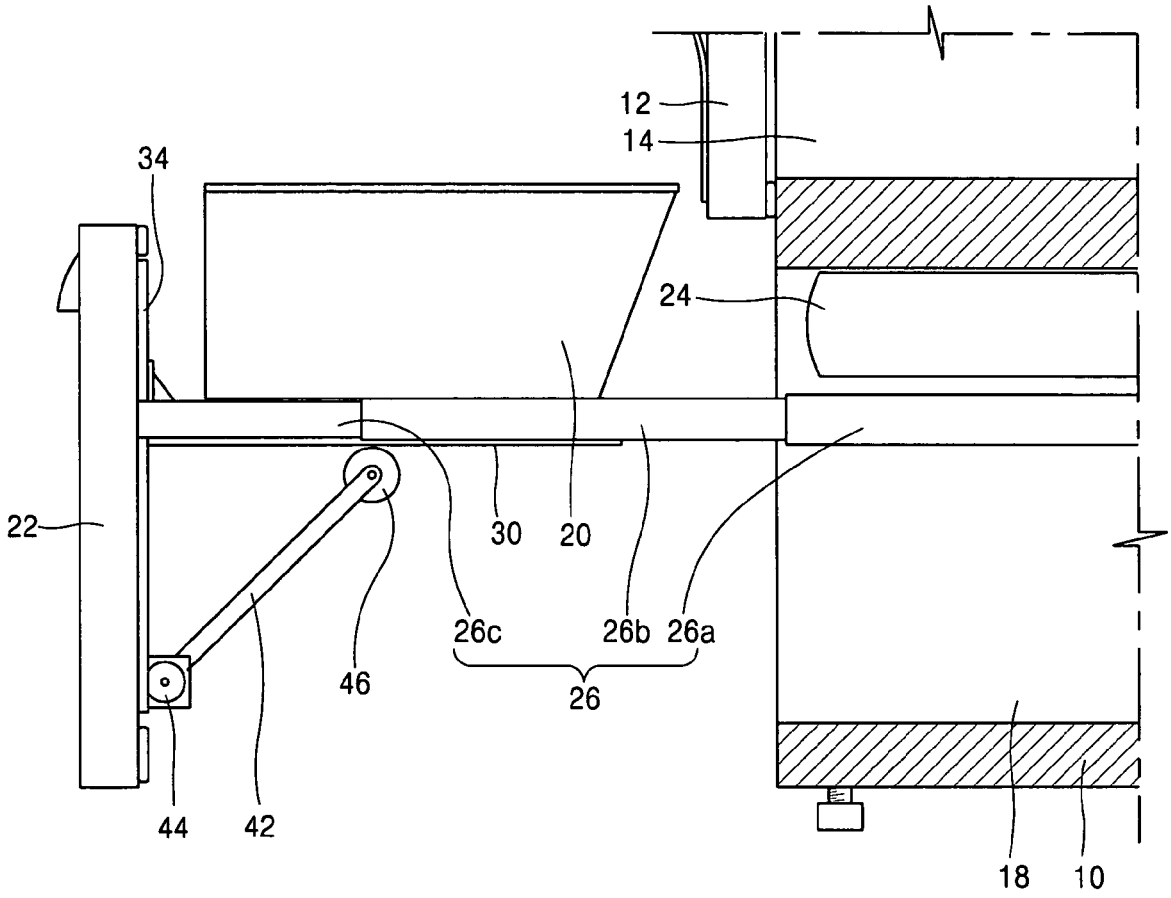
FIG. 10 is an operation state view of the basket lift apparatus of the refrigerator according to the present invention.

FIG. 10 is a lateral view showing a state that the basket lift apparatus of the refrigerator according to the present invention.

When the user pulls the lower door 22, the frame 30 is slid along the guide rail 26 thereby to be drawn out of the lower cooling chamber 18. At this time, the basket 20 positioned on the frame 30 is exposed to the outside.

Under this state, when the user presses the first switch 66 mounted at the front surface of the lower door 22, the controller 74 forwardly drives the driving motor 44.

Then, the rotation shaft 46 of the driving motor 44 is rotated and thereby the driving gear 60 fixed to the rotation shaft 46 is rotated. As the driving gear 60 is rotated, the driven gear 62 gear-engaged with the driving gear 60 is rotated thereby to rotate the hinge shaft 48 in a forward direction. According to this, the driving arm 42 fixed to the hinge shat 48 is rotated, and thereby the roller 47 mounted at one end of the driving arm 42 is roll-motioned at the lower surface of the lifting frame 30 thus to lift the lifting frame 30. When the lifting frame 30 is lifted to the maximum, the first sensor 70 senses the lifted state of the lifting frame 30 thus to apply the sensed signal to the controller 74. Then, the controller 74 stops the driving motor 44.

When the hinge shaft 48 is rotated in a forward direction, the ball 86*b* of the one-way bearing 86 of the damping unit 80 is roll-motioned and thereby the inner wheel 86*c* is freely rotated. According to this, a damping force is not applied to the hinge shaft 48.

When the user presses the second switch 68 after accommodating food in the basket 20 or taking food out of the basket 20, the controller 74 backwardly drives the driving motor 44. According to this, the hinge shaft 48 is backwardly rotated thereby to descend the lifting frame 30. When the descent of the lifting frame 30 is completed, the second sensor 72 senses the descended state of the lifting frame 30 and applies the sensed signal to the controller 74. Then, the controller 74 stops the driving motor 44.

When the hinge shaft 48 is backwardly driven, a damping force is generated from the damping unit 80 thereby to gradually descend the lifting frame 30.

That is, when the hinge shaft 48 is backwardly driven, the ball 86*b* of the one-way bearing 86 is locked between the inner wheel 86*c* and the outer wheel 86*a* and thereby the inner wheel 86*c* and the outer wheel 86*a* are integrally rotated with the ball 86*b*. According to this, the bearing connection portion 90*a* of the connection member 90 mounted at an outer circumferential surface of the outer wheel 86*a* of the one-way bearing 86 is together rotated with the outer wheel 86*a* and the inner wheel 86*c*, and the rotation shaft 90*b* integrally connected to the bearing connection portion 90*a* is rotated, thereby rotating the rotation member 88. According to this, the rotation member 88 generates a damping force while being rotated in the viscosity fluid. By the damping force, the hinge shaft 48 is gradually rotated in a backward direction thereby to gradually descend the lifting frame 30.

Figure 11:
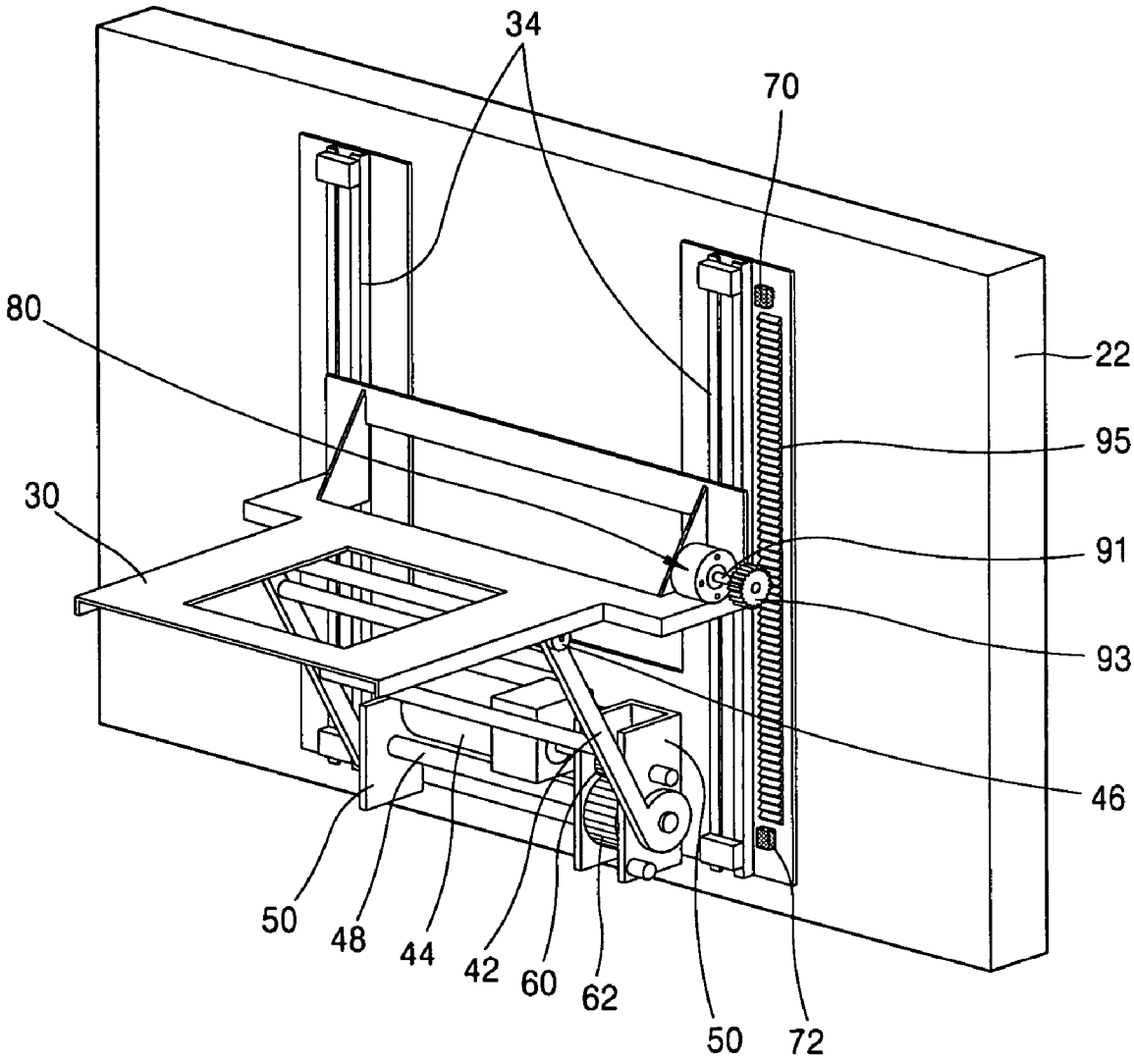
FIG. 11 is a perspective view showing a basket lift apparatus having a damping unit according to a second embodiment of the present invention.
Figure 12:
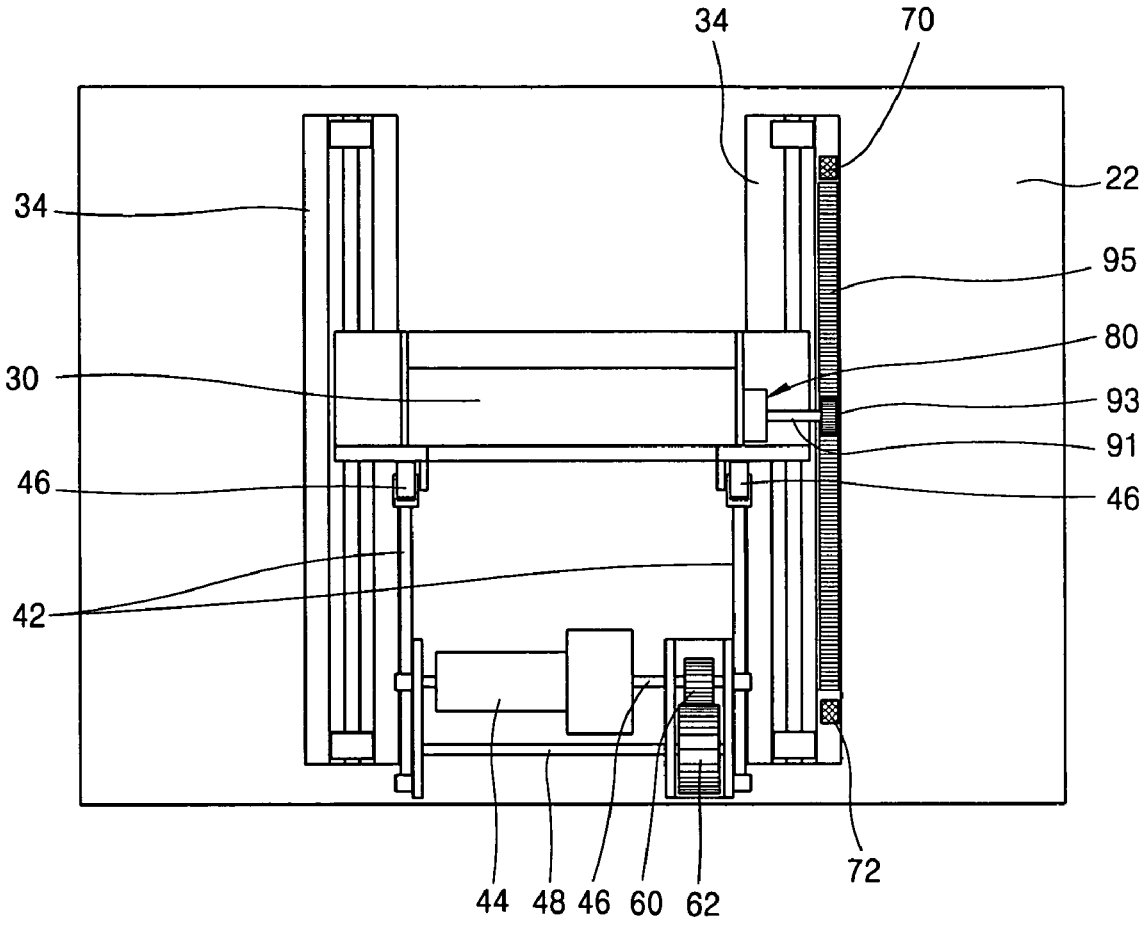
FIG. 12 is a frontal view showing the basket lift apparatus having a damping unit according to the second embodiment of the present invention.

FIG. 11 is a perspective view showing a basket lift apparatus having a damping unit according to a second embodiment of the present invention, and FIG. 12 is a frontal view showing the basket lift apparatus having a damping unit according to the second embodiment of the present invention.

The damping unit according to the second embodiment is fixed to the lifting frame 30, and a rotation shaft 91 is connected to the inner wheel 86*c* of the one-way bearing 86. A rack gear 93 is fixed to the rotation shaft 91, and the rack gear 93 is gear-engaged with a pinion gear 95 vertically mounted at a rear surface of the lower door 22.

When the lifting frame 30 is lifted, the ball 86*b* of the one-way bearing 86 is roll-motioned and does not rotate the rotation member 88. According to this, a damping force is not generated. Also, when the lifting frame 30 is descended, the ball 86*b* of the one-way bearing 86 is locked between the outer wheel 86*a* and the inner wheel 86*c* and thereby the one-way bearing 86 is integrally rotated. According to this, the rotation member 88 is rotated thus to generate a damping force. According to this, the rack gear 93 fixed to the rotation shaft 91 is slowly moved and thus the lifting frame 30 is gradually descended, thereby absorbing an impact generated when the basket is descended.

Effects of the refrigerator having a basket lift apparatus according to the present invention will be explained as follows.

As the basket is drawn out of the lower cooling chamber, the basket is lifted by using the basket lift apparatus. According to this, the user can take out food stored in the basket without bending his or her waist thereby to enhance the user's convenience.

Also, a damping force is generated when the basket is descended by the damping unit installed at the basket lift apparatus, thereby absorbing an impact generated when the basket is drastically descended.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a cooling chamber;

a basket arranged at the cooling chamber for storing food;

a door arranged at a front side of the cooling chamber and movable in back and forth directions;

a basket lift apparatus for lifting the basket; and a damping unit installed at the basket lift apparatus for attenuating an impact generated when the basket is lowered, wherein the basket lift apparatus includes:

a pair of lifting rails connected to the door;

a lifting frame movably connected to each of the pair of lifting rails, and on which the basket is positioned;

a pair of driving arms contacting a lower surface of the lifting frame to be roll-motioned and rotatably supported at the door b a hinge shaft; and a driving unit connected to the hinge shaft to rotate the pair of driving arms, and wherein each of the driving arms is provided with a roller roll-motioned at the lower surface of the lifting frame at one end thereof, the pair of driving arms being connected by the hinge shaft extending therebetween, the hinge shaft being rotatably supported by a supporting bracket fixed to a rear surface of the door, and wherein a distance between the connections of the lifting frame to the pair of lifting rails measured in a lateral direction of the door is greater than a distance between the pair of driving arms measured in the lateral direction of the door.

2. The refrigerator of claim 1, wherein the damping unit is connected to the hinge shaft, and generates a damping force only when the hinge shaft is rotated in one direction.

3. The refrigerator of claim 1, wherein the damping unit comprises:

a housing fixed to the door and having a chamber in which fluid is contained; and a rotation member rotatably arranged at the chamber of the housing and connected to the hinge shaft for generating a damping force.

4. The refrigerator of claim 3, wherein the damping unit further comprises a one-way bearing to which the hinge shaft is fixed and connected to the rotation member by a connecting member, for generating a damping force only when the hinge shaft is rotated in a direction to lower the basket.

5. The refrigerator of claim 3, wherein the housing comprises a first member and a second member mounted with a sealed state, a chamber for containing a fluid is formed between the first member and the second member, and a coupling flange having a bolt coupling hole for bolt-coupling a supporting bracket fixed to the door is formed at an edge of the housing.

6. The refrigerator of claim 4, wherein the one-way bearing comprises:

an outer wheel rotatably arranged at a mounting groove formed at the housing;

an inner wheel arranged at an inner circumferential surface of the outer wheel with a certain interval and having a hinge shaft fixed to a center thereof; and a ball mounted between the outer wheel and the inner wheel with the same interval, roll-motioned when the hinge shaft is rotated in a direction to lift the basket, and integrally rotated with the hinge shaft by locking a space between the inner wheel and the outer wheel when the hinge shaft is rotated in a direction to lower the basket.

7. The refrigerator of claim 6, wherein the connecting member comprises:

a bearing connecting unit mounted at an outer circumferential surface of the outer wheel and rotated together; and a rotation shaft connected to the bearing connecting unit and fixed to a center of the rotation member.

8. The refrigerator of claim 1, wherein the damping unit is fixed to the lifting frame and generates a damping force when the lifting frame is lowered.

9. The refrigerator of claim 8, wherein the damping unit comprises:

a housing fixed to the lifting frame and having a chamber in which fluid is contained;

a rotation member rotatably arranged at the chamber of the housing; and a one-way bearing to which a rotation shaft is fixed and connected to the rotation member by a connecting member, for generating a damping force only when the lifting frame is lowered.

10. The refrigerator of claim 9, wherein a rack gear is connected to the rotation shaft and the rack gear is gear-engaged with a pinion gear fixed to a rear surface of the door.

* * * * *